US012163343B2

(12) United States Patent
Schmid

(10) Patent No.: US 12,163,343 B2
(45) Date of Patent: Dec. 10, 2024

(54) SELF-CLIMBING SYSTEM WITH DRIVE VIA A CIRCULATING DRIVE MEANS AND METHOD FOR OPERATING A SELF-CLIMBING SYSTEM

(71) Applicant: PERI SE, Weissenhorn (DE)

(72) Inventor: Josef Schmid, Balzheim (DE)

(73) Assignee: PERI SE, Weissenhorn (DE)

( * ) Notice: Subject to any disclaimer, the term of this patent is extended or adjusted under 35 U.S.C. 154(b) by 759 days.

(21) Appl. No.: 17/045,485

(22) PCT Filed: Apr. 1, 2019

(86) PCT No.: PCT/EP2019/058132
§ 371 (c)(1),
(2) Date: Oct. 5, 2020

(87) PCT Pub. No.: WO2019/192946
PCT Pub. Date: Oct. 10, 2019

(65) Prior Publication Data

US 2021/0032886 A1 Feb. 4, 2021

(30) Foreign Application Priority Data

Apr. 3, 2018 (DE) ..... 102018204961.0

(51) Int. Cl.
*E04G 11/28* (2006.01)
*E04G 3/28* (2006.01)
*E04G 21/32* (2006.01)

(52) U.S. Cl.
CPC ..... *E04G 11/28* (2013.01); *E04G 3/28* (2013.01); *E04G 21/3223* (2013.01); *E04G 21/3247* (2013.01); *E04G 2003/286* (2013.01)

(58) Field of Classification Search
CPC ..... E04G 11/28; E04G 11/20; E04G 3/28; E04G 3/30; E04G 21/3223;
(Continued)

(56) References Cited

U.S. PATENT DOCUMENTS 7,232,009 B1 * 6/2007 White ..... B66B 9/04 182/133
2009/0041879 A1 2/2009 Baum
(Continued)

FOREIGN PATENT DOCUMENTS

CN 105625704 6/2016
DE 2446477 3/1976
(Continued)

OTHER PUBLICATIONS

KR-100746551-B1 Translation Aug. 2007 (Year: 2007).*
"RCS Rail Climbing System," Peri GmbH Oct. 2017.

*Primary Examiner* — Jessica L Laux
*Assistant Examiner* — Kathleen M. McFarland
(74) *Attorney, Agent, or Firm* — SLEMAN & LUND LLP

(57) ABSTRACT

A self-climbing system, in particular a self-climbing formwork system, comprising at least one climbing rail which is guided on at least two climbing shoes, in particular an upper and a lower climbing shoe, wherein the climbing shoes can be fastened on and/or on top of a cured concreting section, and an actuator. A circulating drive means is arranged along the climbing rail, at least over a length portion of the climbing rail, can be moved relative to the climbing rail by means of the actuator and can be selectively blocked or unlocked in the region of a climbing shoe and/or in the climbing shoe by means of at least one fixing device. Furthermore, a method for operating a self-climbing system according to the invention. The invention opens up an improved climbing principle for self-climbing systems whereby, for example, continuous climbing becomes possible.

20 Claims, 10 Drawing Sheets

(58) Field of Classification Search
CPC . E04G 21/3247; E04G 5/14; E04G 2003/286; H02K 7/003; H02K 9/193
See application file for complete search history.

(56) References Cited

U.S. PATENT DOCUMENTS

2011/0037186 A1* 2/2011 Sundermann ..... E04G 11/065 425/65
2018/0023308 A1* 1/2018 Aranburu Etxezarreta ..... E04G 21/3247 52/126.1

FOREIGN PATENT DOCUMENTS

| | | | |
|---|---|---|---|
| DE | 19920164 | | 11/1999 |
| EP | 0034819 | | 9/1981 |
| EP | 0034819 | A2 * | 9/1981 |
| KR | 100746551 | | 8/2007 |
| KR | 100746551 | B1 * | 8/2007 |
| KR | 101646892 | | 8/2016 |
| WO | 2007000136 | | 1/2007 |
| WO | 2007000136 | A1 | 1/2007 |

* cited by examiner

SELF-CLIMBING SYSTEM WITH DRIVE VIA A CIRCULATING DRIVE MEANS AND METHOD FOR OPERATING A SELF-CLIMBING SYSTEM

FIELD OF THE INVENTION

The invention concerns a self-climbing system, in particular a self-climbing formwork system, comprising at least one climbing rail, which carries at least two climbing shoes, in particular an upper and a lower climbing shoe, wherein the climbing shoes can be fastened on and/or on top of a cured concreting section, and an actuator.

BACKGROUND OF THE INVENTION

A climbing system has, for example, become known in the form of the "RCS Rail Climbing System" from Peri GmbH, Weiβenhorn, Germany, (http://www.peri.de/produkte/schalungsysteme/rcsschienenklettersystem.html; released on Sep. 25, 2017).

Such a rail climbing system facilitates vertical, rail-guided climbing of climbing units, which for example comprise formwork elements, work platforms and/or coverings, along a wall surface to be constructed, in a stepwise manner over several floors. The wall surface that is to be constructed is usually in the form of a cured concreting section.

For purposes of climbing, the climbing unit, along with one or more associated climbing rails, is moved, for example hydraulically or by means of a crane, from a lower floor to another, upper level floor. In the case of the known systems, for example a hydraulic actuator then respectively supports itself on a climbing rail mounted on the wall of a lower floor that is to be climbed so as to displace the climbing rail upward and/or in the desired climbing direction.

The actuator can thereafter be dismounted and it can then be mounted again on a wall of a higher floor (if it is necessary to keep climbing), so that the climbing operation can be continued. The climbing rails are then respectively held in the climbing shoes during climbing operation. After reaching the desired floor, i.e. after the conclusion of a climbing operation, the climbing rails can be immobilized in or on top of the climbing shoes, for example by means of a pin, so as to exclude the possibility of sliding back.

A climbing shoe of a climbing formwork is for example known from WO 2007/000136 A1.

It is however a disadvantage of the known climbing systems that it is only possible to climb intermittently; for example, extensive manual interventions are in particular required for relocating the actuator(s). When using several climbing rails disposed in parallel, in particular by using several climbing units, which are, for example, disposed all around a building that is to be constructed, it is very difficult to achieve a synchronous displacement of the climbing units. This can cause danger zones, in particular crash sites, to develop while climbing.

It is furthermore only possible to achieve low climbing speeds via the known climbing systems. Periodic return strokes are needed if lifting cylinders are, for instance, used as actuators.

A main climbing setup often comes about for a particular construction job. It is then very difficult and/or only possible at considerable expenditure to climb in the opposite direction. For instance, climbing back when performing demolition work often demands a considerable effort. Lifting cylinders, particularly lifting spindles, additionally exhibit considerable friction, resulting in significant frictional losses. The actuators can furthermore often only be insufficiently protected from pervasive dirt at construction sites.

SUMMARY OF THE INVENTION

It is therefore the object of the invention to offer an alternative, improved self-climbing system as well as a method for operating a self-climbing system that achieves a novel climbing principle.

This task is accomplished by a self-climbing system, in particular a self-climbing formwork system, comprising at least one climbing rail, which is guided onto at least two climbing shoes, in particular an upper and a lower climbing shoe, wherein the climbing shoes can be fastened on and/or on top of a cured concreting section, and an actuator, with a circumferential drive means disposed along the climbing rail, at least over a length section of the climbing rail, which drive means is movable relative to the climbing rail by means of the actuator and can be selectively blocked or unlocked in the region of a climbing shoe by means of at least one fixing device for the drive means.

It is thus an important aspect of the invention that a climbing rail is provided, at which a circumferential drive means is disposed. The self-climbing system furthermore comprises at least two climbing shoes. The lengthwise section of the climbing rail with the drive means can be clasped by the climbing shoes or taken up in the climbing shoes. The drive means can be fixed in the region of one of the climbing shoes and/or in one of the climbing shoes by means of the fixing device. In other words, the drive means is fixed (blocked) relative to one of the climbing shoes of the self-climbing system, in particular so that any movement of the drive means in its longitudinal direction relative to the climbing shoe is prevented. The drive means also remains movable with respect to the climbing rail while it is in its fixed condition relative to the climbing shoe. If the drive means is moved, i.e. if it is displaced along the length of the climbing rail, it is then possible for the entire climbing rail to be moved. Depending upon the direction of motion of the drive means along the longitudinal section, the climbing rail can then climb either in one or in another, particularly in an opposite, climbing direction. The actuator can thus act as a climbing drive; it can in particular propel the drive means.

The actuator can thus climb along with the climbing rail and does not have to be carried along and/or relocated. Any back-climbing is achievable via a simple reversal of direction of the actuator and/or by a reversal of the direction of the movement of the drive means. The climbing speed can be increased; it is in particular possible to climb without interruption, continuously.

By monitoring the speed of the drive means, for example by measuring the speed of rotation of a drive wheel, it is possible to achieve an absolute synchronization of several, in particular parallel, climbing units, which advantageously respectively comprise a self-climbing system according to the invention. Accident prone sites are avoided while climbing. For purposes of monitoring of the speed, the self-climbing system can comprise an electronic control device, which is configured to control the speed of the drive means, in particular to set an identical speed of the drive means of several climbing rails.

The circumferential drive means can be a chain, preferably a continuous chain, belt or ribbon. A chain is particularly robust and can be installed next to the climbing shoe in a dirty condition. The chain can preferably be configured as a link chain (round link chain). A belt or a ribbon used as a drive means is preferably also configured as circumferentially closed. A belt or a ribbon allows for a particularly precise alignment of the climbing rail relative to the climbing shoe, since these drive means can be clamped at any location.

It is also conceivable for the actuator to be configured as an electrical, hydraulic and/or pneumatic and/or self-locking chain drive or to have such a drive. If, for example, the actuator is configured as a self-locking chain drive, provisions can be made for the chain to be movable in one particular direction and blocked in the opposite direction. It is thus possible to avoid any backward slippage of the climbing rail, for example when the climbing drive is switched off.

The entire self-climbing system and/or the entire climbing unit can be displaced by means of the drive means, so that, depending on the size and weight of the climbing system, it is possible to deal with significant loads and/or considerable forces acting on the drive means, which can be equipped by an electrical, hydraulic and/or pneumatic drive. In other words, the actuator is designed to overcome forces acting on the self-climbing system against the climbing direction.

It is also possible to ensure that the climbing rail has at least two means of redirection for redirecting the drive means. This makes it possible to achieve a low friction motion of the drive means. The means of redirection is disposed on both sides of the longitudinal section. The means of redirection can, e.g., comprise gear wheels, chain wheels or preferably pocket wheels if the drive means is a chain. Deflection rollers can be used as a means of redirection for a belt, a ribbon or a chain as well as used as a drive means.

It can also be provided that the climbing rail has a tensioning element for setting the tension of the drive means or that such a tensioning element is disposed on the climbing rail. It is by means of the tensioning element that the drive means can, for example, be set to deal with different tensioning situations and/or lengths of the longitudinal section. The chain tensioner can, in particular, be designed to be put under tension independently. It can, for example, be provided that the chain tensioner always ensures a given track tension and/or a minimum track tension.

A chain used as a drive means is particularly preferably a link chain or a roller chain. As a result of this, the chain can be blocked and/or unlocked in a particularly simple manner. Such a chain furthermore has a particularly high tensile strength. A belt is preferably a toothed belt. It is by this means that the occurrence of slippage between the actuator and the belt can be avoided during propulsion. A toothed belt of a drive means in the form of a belt drive can additionally be blocked particularly reliably relative to the climbing shoe.

A guide for the drive means can be provided on the climbing shoes. The drive means can thus be taken up particularly simply and surely on and/or between the climbing shoes.

The guide can be configured as a guidance slot so as to allow the drive means to pass through. The guidance slot and/or the climbing shoe can preferably be opened so that the drive means can be removed. The guidance slot can preferably be located between at least two claws, which can in particular be spread apart. The claws can thus be opened and/or closed. The drive means can thus be inserted more simply into the climbing shoes or removed from the latter.

It can be provided that opening the guidance slot is blocked and/or can at least be blocked by means of a slot barrier if the climbing shoe associated with the guidance slot is located in a predefined climbing region with respect to the drive means and/or the climbing rail. The climbing operation can thus be performed independently; in particular, the slot barrier can be controlled in such a manner that the chain and thus the climbing rail is respectively held and/or blocked at the points needed for climbing.

It is also conceivable that at least one climbing shoe is configured as a slab shoe and/or as a wall climbing shoe. The climbing shoe can thus, e.g., respectively be mounted on freshly produced, particularly a hardened slab and/or wall.

It is also conceivable that the fixing device is configured as at least one fixing pin, a claw or a latch and/or that the fixing device comprises at least one fixing pin, a claw or a latch, with the fixing device designed to immovably block or to release the drive means in the domain of the climbing shoe. This offers a particularly simple way of blocking or releasing the drive means. The fixing device can consequently be dimensioned and/or designed so that it can permanently absorb considerable stresses and/or forces by itself.

The fixing device can be manually operable at the climbing shoe associated therewith, so that the climbing process can be controlled manually. To this end, it is for example possible to slide the fixing bolt into the fixing device or to pull it out of the fixing device depending on the respective stage of the climb. It is conceivable for the fixing device to be operable automatically, by remote control, independently and/or in a guided manner. This further simplifies the operation of the self-climbing system.

It can be provided that the fixing device has a snap-in locking device by means of which the drive means can be locked at least along the climbing direction, in particular for stationarily fixing the drive means at the snap-in locking device. The snap-in locking device can in particular prevent any unintended back-climbing. The snap-in locking device can generally enable independent climbing It can also be provided that the self-climbing system has at least one status sensor for purposes of recording and/or monitoring the lifting power of the drive means, the tension of the drive means, the position and/or the speed of rotation of the drive means, the position of the climbing rail, particularly relative to at least one of the climbing shoes and/or relative to the drive means, the torque and/or the number of revolutions of a drive wheel of the actuator for the propulsion of the drive means. It is thus by means of the status sensor that the climbing process can be monitored. Any errors that may arise can be detected promptly. If an error arises while climbing, the climbing process can, for example, at least be stopped or interrupted automatically. It is also possible to trigger a warning signal. The monitoring can be performed in a very simple way, since a variety of parameters that can be captured is available. It is also possible to monitor the position of the climbing rail with respect to the concreting section—in particular during a normal operation. It is thus, for example, possible to determine whether a desired final position has already been reached. The climbing process can be automatically terminated in this event. The status sensor can be configured as transmitter, which determines a position of the drive means and/or of the climbing rail via the number of turns of a drive wheel of the actuator.

It is also conceivable that the self-climbing system comprises an additional climbing rail with an additional drive means rotating along an additional climbing rail, in particular rotating endlessly, where the self-climbing system is designed to move the drive means and the additional drive means in mutual coordination, in particular synchronously.

In doing so, the additional climbing rail can be of a design that is similar to that of the already existing climbing rail. This makes it possible to install a climbing unit on several climbing rails. It is also, e.g., possible to cover additional sections of a building that is to be constructed with the self-climbing system. For example, the entire building can be equipped all around with a self-climbing system having several climbing rails. The climbing rails can be coordinated with each other, they can in particular be moved synchronously. It is thus particularly possible to avoid the formation of crash sites while climbing.

The self-climbing system can, for example, comprise a work platform, a finishing platform, a safety enclosure, a formwork system and/or a protective screen.

The self-climbing system can have at least one emergency backup unit. The emergency backup unit can, for example, be a friction clutch. The emergency backup unit can, in particular, be constituted of a self-locking actuator. It can preferably be located and/or installed at the climbing rail and/or at least one of the climbing shoes. It can be constructed in a manner such that it independently prevents any movement of the climbing rail counter to the desired climbing direction and/or in the climbing direction, but at a speed exceeding the limiting speed. It can in particular be provided that the emergency backup unit blocks any movement if the drive means is damaged, e.g. torn.

The fixing device can be mounted in a movable way on the climbing shoe along the length of the climbing rail, preferably so that the fixing device is pretensioned in a starting position. A limit-stop mechanism can limit the mobility of the fixing device in one or both directions along the longitudinal section. A locking mechanism is preferably provided, which rigidly fixes the fixing device relative to the climbing shoe if the fixing device blocks the drive means at the climbing shoe. This enables a particularly soft, i.e. smooth or jerk-free, transition of the load transfer from a first to a second climbing shoe of the self-climbing system, particularly if the drive means is a chain, which can only be blocked by the fixing means at discrete positions (perhaps by engaging one of the chain links).

The self-climbing system can alternatively or additionally comprise a tensioning mechanism for the drive means, which is designed to tension the drive means in a region between a first and a second climbing shoe. The tensioning mechanism can, e.g., comprise a preferably hydraulic lifting cylinder, one side of which is linked to the load rail and the other side has a holding mechanism for securing the drive means. By this means, the load of the self-climbing system can be gently transferred from the first to the second climbing shoe, in particular when the drive means is a chain, which can only be blocked by the fixing means at discrete positions (possibly by engaging one of the chain links). To accomplish this, the drive means is also first blocked at the second climbing shoe. The tensioning mechanism then tensions the drive means between the second climbing shoe and its point of attack on the drive means. This point of attack basically lies between the two climbing shoes. By this means the load (e.g. weight force) of the self-climbing system is increasingly transferred to the second climbing shoe. A load path runs through the tensioning mechanism. In doing so, the actuator is typically deactivated, i.e. it does not move the drive means. A passive tensioning element is preferably placed on a trailing belt strand of the drive means between the actuator and the second climbing shoe. This provides a needed tensioning path for the tensioning mechanism. Once the load has been transferred to the second climbing shoe, the blockage of the drive means at the first climbing shoe can be suspended. The actuator can then increasingly continue to move the drive means so that the latter is again put in tension between the point of attack of the clamping mechanism and the actuator. The load of the self-climbing system thereby again increasingly passes from the tensioning mechanism to the actuator. Once the latter has taken on the load, the clamping mechanism can be disengaged from the drive means.

The scope of this invention additionally includes a method for operating a self-climbing system according to this invention, wherein the drive means is moved with respect to the climbing rail while the drive means is blocked, at least in sections, in the domain of a climbing shoe and/or in the climbing shoe. The method according to the invention thus provides for moving the climbing rail only indirectly along on the climbing shoe. A provision is particularly made to move the drive means with respect to the climbing rail while it is blocked, at least in sections, in the domain of the climbing shoe and/or in the climbing shoe. Like a tracked vehicle, which quasi-unreels a continuous chain on the ground, the drive means of the climbing system can unreel along a building wall that is, for example, to be constructed. While the drive means-endlessly—unreels on the building wall, the climbing rail, corresponding to the tracked vehicle, is accordingly taken along automatically. The climbing rail can thus also climb, albeit indirectly, along the building wall. The resulting climbing direction can be determined by the direction of movement of the chain with respect to the climbing rail.

According to this method, provision can be made to block the drive means at a respective first climbing shoe until the climbing rail, along with the drive means, reaches a second climbing shoe and/or has climbed over the latter in a prescribed manner. The drive means can then be set down and/or blocked again at the second climbing shoe positioned further along the climbing direction. The blockage at the first climbing shoe can then be disengaged.

The position of the climbing rail can be fixed during this change of climbing shoes. To this end, the drive means can be fixed in its position relative to the climbing rail, for example by means of the actuator.

The climbing process can subsequently be continued as the drive means is moved along.

A stretch of a—particularly a cured—concreting section can thus be climbed. The wall of a building can, in particular, act as a concreting section.

Climbing shoes that are spaced apart can be positioned on the concreting section, in particular on the building wall, over the entire distance that is to be climbed. According to this method, the climbing rail can then guide the respective climbing shoe that is to be climbed over.

The climbing rail can also additionally be guided through a respective next climbing shoe reached while climbing.

In an alternative method, the change can take place manually; a fixing pin can in particular be removed manually from the first climbing shoe that is to be unlocked. A, in particular the fixing pin can be inserted into the second climbing shoe that is to be blocked for purposes of blocking it.

In another alternative of the method, the change can also take place autonomously. The climbing shoes can, in particular, be designed to actuate or loosen, i.e. to unlock, the blockage autonomously, in particular by unlatching or via a control unit.

Further characteristics and advantages of the invention arise from the following detailed description of an example embodiment of the invention by means of the drawings, which show details according to the invention, as well as from the claims.

The aforesaid, further elaborated characteristics can be realized separately for or in several arbitrary combinations as variants of the invention.

The schematic drawings show example embodiments of the invention, which are described in greater detail in the subsequent description.

DETAILED DESCRIPTION

The same reference symbols are used for the same or corresponding elements for purposes of facilitating an understanding of the invention. The reference symbols of FIG. 1 to FIG. 5 are also referred to in the description of the elements of the climbing system used for the method of this invention.

Figure 1:
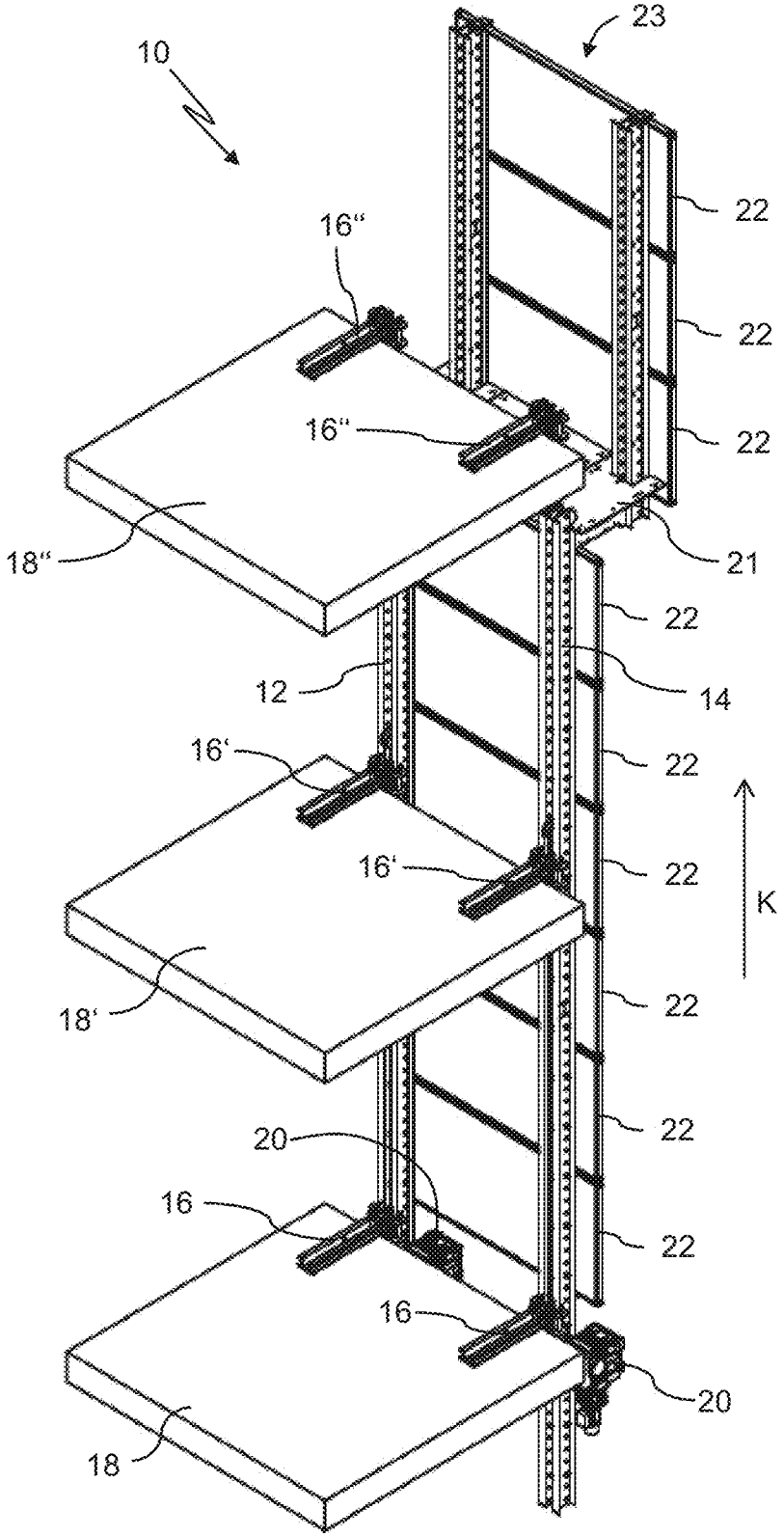
FIG. 1 a perspective view of a self-climbing system.

FIG. 1 shows a self-climbing system 10. The self-climbing system 10 respectively comprises a first climbing rail 12 and a second climbing rail 14. The climbing rails 12, 14 are disposed in parallel to each other.

The self-climbing system 10 furthermore comprises several climbing shoes 16, 16', 16" in the form of slab shoes, with FIG. 1 showing a total of six climbing shoes 16. Two of the climbing shoes 16, 16', 16" at a time, are fastened to respective cured concreting sections 18, 18', 18" shown in FIG. 1, in particular pairwise to a slab. Each of the climbing shoes 16, 16', 16" can, in general, be fastened to a concreting section 18, 18', 18". Each concreting section 18, 18', 18" respectively represents a section of a-just constructed-floor of a building under construction. It is not possible to show the climbing shoes on the outside surface of a wall attached as wall climbing shoes.

At the stage of the climbing process shown in FIG. 1, each of the two climbing rails 12, 14 guide two of the climbing shoes 16, 16', in particular past an upper climbing shoe 16' and a lower climbing shoe 16 in an upward-leading climbing direction K as shown here. At the stage shown in FIG. 1, the upper climbing shoes 16' then correspond to the climbing shoes 16' fastened to the middle one of the three concreting sections 18'.

Each of the climbing rails 12, 14 furthermore carries an actuator 20. The actuators 20 are configured as hydraulic drives. But the hydraulic drives can as well be replaced by electrical and/or pneumatic drives.

Several protective covers 22, e.g. to protect against dirt, to protect against falling parts, as well as to act as fall protection devices for workers, are disposed on the climbing rails 12, 14.

It is evident that the uppermost protective covers 22 are indirectly disposed on the first climbing rails 12 via a work platform 21. The protective covers 22 collectively form a protective housing 23.

Figure 2:
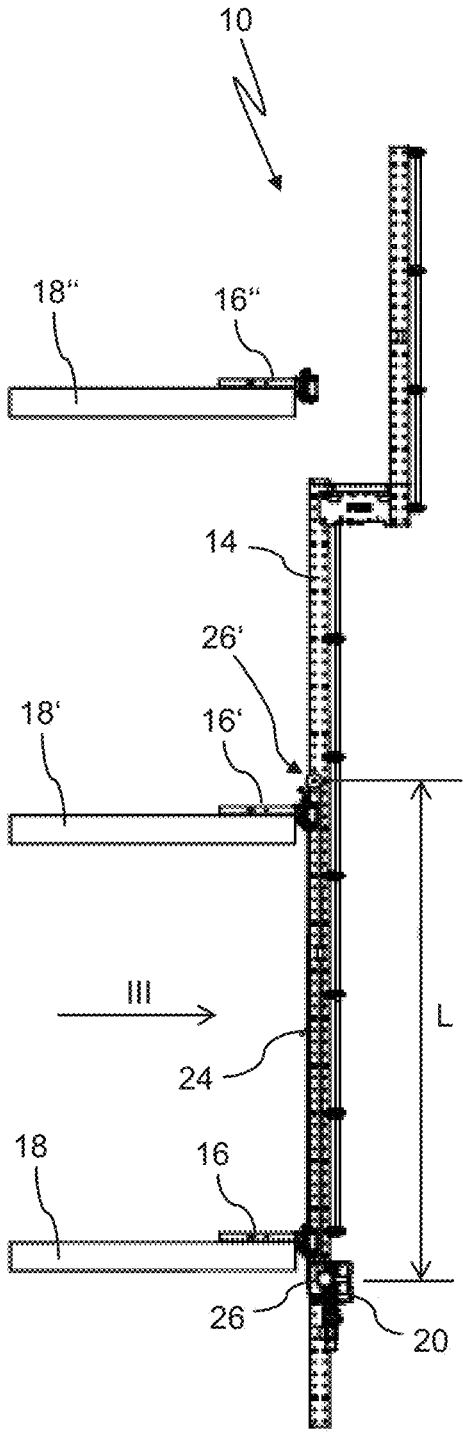
FIG. 2 and FIG. 3 a side view as well as a front view of the self-climbing system of FIG. 1.

FIG. 2 shows a side view of the climbing system 10. The climbing rail 12 of FIG. 1 is hidden in the side view of FIG. 2. The climbing rail 14 extends to below the uppermost concreting section 18" in the climbing stage depicted in FIG. 2 and FIG. 1. Climbing shoes 16" are already fastened to this uppermost concreting section 18" in this climbing stage.

Figure 3:
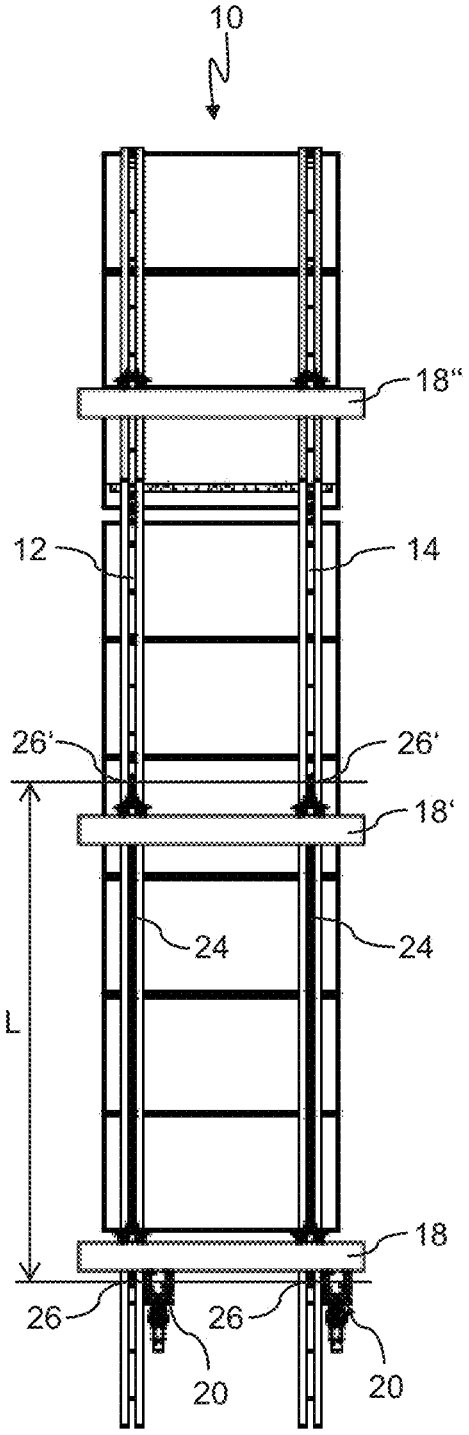

FIG. 3 shows a front view of the climbing system 10 as seen in the direction of the arrow III of FIG. 2. Looking at both FIG. 2 and FIG. 3 it is evident that the actuators 20 of the climbing rails 12, 14 are connected by one drive means, in this case a chain 24. In this example embodiment the chains 24 are configured as roller chains.

The chains 24 are disposed in an endlessly revolving manner over a length section L of the climbing rails 12, 14. In doing so, they are redirected at their rotational points by means of redirection, in this case gear wheels 26, 26'.

At least one of the gear wheels 26, 26' of each climbing rail 12, 14, for example the one at the upper rotational point (the gear wheels 26'), is configured so that it is displaceable against spring tension in the longitudinal direction of longitudinal sections L and thus constitutes a chain tensioner for setting the tension of the chain 24.

The gear wheels 26, 26' can be moved, in particular propelled, with respect to the respective climbing rails 12, 14 by means of the actuators 20. It is then possible to select the direction of rotation of the chains 24 around the length sections L depending upon the control of the actuators 20. The actuators 20 are driven in coordinated manner, in particular synchronously, and thus in coordination with one another. The chains 24 are thus movable in a coordinated manner, in particular synchronously.

Figure 4:
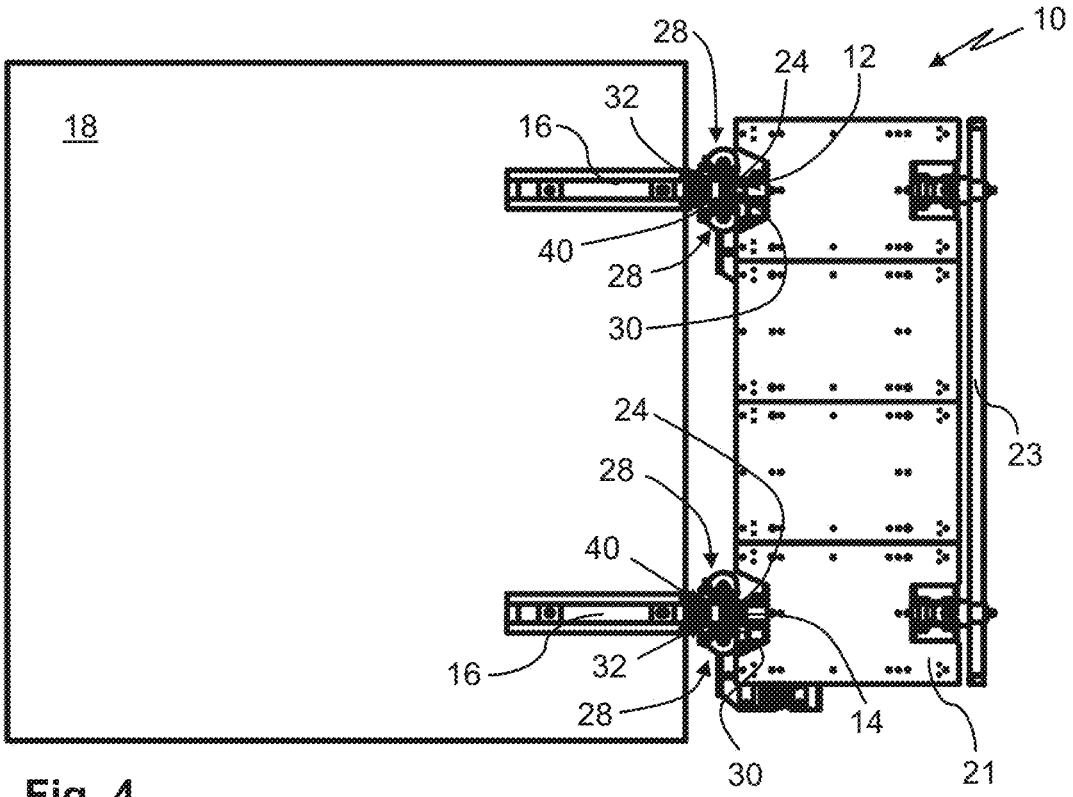
FIG. 4 a magnified detailed depiction of a cutout of the self-climbing system of FIG. 1 as seen from the top.
Figure 5:
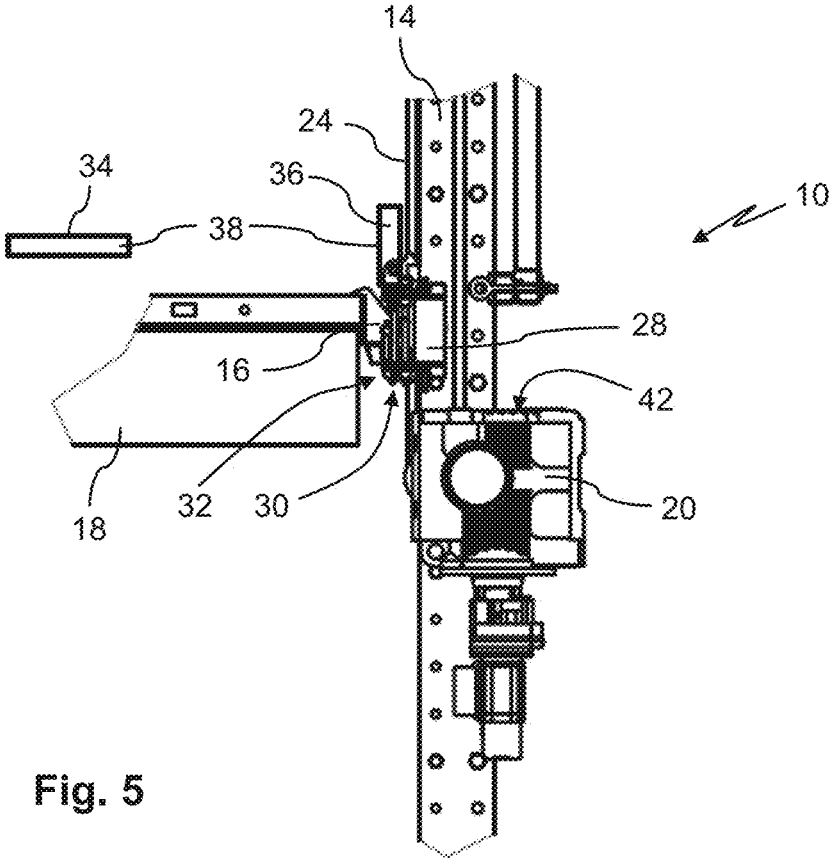
FIG. 5 a magnified side view of a cutout of the self-climbing system of FIG. 1 with a climbing shoe.

FIG. 4 shows a magnified detailed representation of the self-climbing system 10 as seen from above. The concreting sections 18', 18" of FIGS. 1, 2, 3 and the climbing shoes 16' 16" fastened to them are not shown in FIG. 4, so that the view goes directly to the concreting section 18 (here a floor) seen from above. Two climbing shoes 16 disposed on the concreting section 18 are particularly visible. For this purpose, FIG. 5 shows a magnified side view of a cutout of the self-climbing system 10, in particular with one of the two climbing shoes 16 of FIG. 4.

It is evident that the climbing shoes 16 respectively have two approximately semicircular claws 28, which can be strutted apart, together respectively forming a guide slot 30 that can be opened. The guide slots 30 particularly serve as the intakes of respectively one of the chains 24. The guide slots 30 can be opened by strutting the claws 28 apart. When the guide slot 30 is opened, it is in particular possible to insert the respective chain 24 and a part of the climbing rail 12, 14 located on the side of the climbing shoe or to remove it therefrom. As long as no chain 24 and no climbing rail 12, 14 is inserted and/or is taken up in the climbing shoes, the claws 28 are strutted apart and the guide slots 30 are open to receive the chains 24.

Each of the climbing shoes 16 furthermore has an independent slot barrier 32, in particular at the claws 28. The slot barriers 32 are configured so that opening the respective guide slot 30 is barred if the climbing shoe 16 associated with the respective guide slot 30 is located in a predefined climbing range with respect to the chain 24 and/or with respect to the respective climbing rail 12, 14.

A schematically shown, freely movable fixing pin 34 along with a pin receiver 36 on each climbing shoe 16 constitutes a fixing device 38 for the drive means, i.e. in this instance for the chain 24. It is by means of the fixing device 38 that the respective chain 24 is alternatively blocked or unblocked in the respective climbing shoe 16. To accomplish this, it merely suffices to push the fixing pin 34 into and through the pin receiver 36 (only shown in FIG. 5 for reasons of presentation) until the fixing pin 34 blocks the chain 24 immovably between two of its members. The chain 24 can be unlocked by removing the fixing pin 34.

In this example embodiment, the fixing pin 34 is freely movable and is thus manually operable at the climbing shoe 16 associated therewith.

In an alternative embodiment, which is also at least schematically shown in FIG. 4 and FIG. 5, the fixing device 38 has a snap-in locking device 40, particularly in the middle range between the claws 28. The snap-in locking device 40 is configured as a hinge that can only be hinged upward, i.e. in the direction of the chain, the hinge being aligned horizontally at rest, and with a return spring for returning the hinge to its resting position. A chain 24 disposed between the claws 28 is thus independently blocked, at least upon any movement of the chain against the climbing direction—and thus upon movement of the climbing rail 12 and/or 14 along the climbing direction—and is fixedly immobilized and/or clicked in place by the snap-in locking device 40.

Status sensors 42 (FIG. 5) are furthermore integrated in the actuators 20. The status sensors 42 are designed to record and/or monitor the position of the respective chain 24, in particular with respect to the chain, and thus to record and monitor the climbing speed.

The recorded climbing speed can, for example, be evaluated by a control unit and can be used for controlling of the actuators 20.

Figures 6, 7, 8:
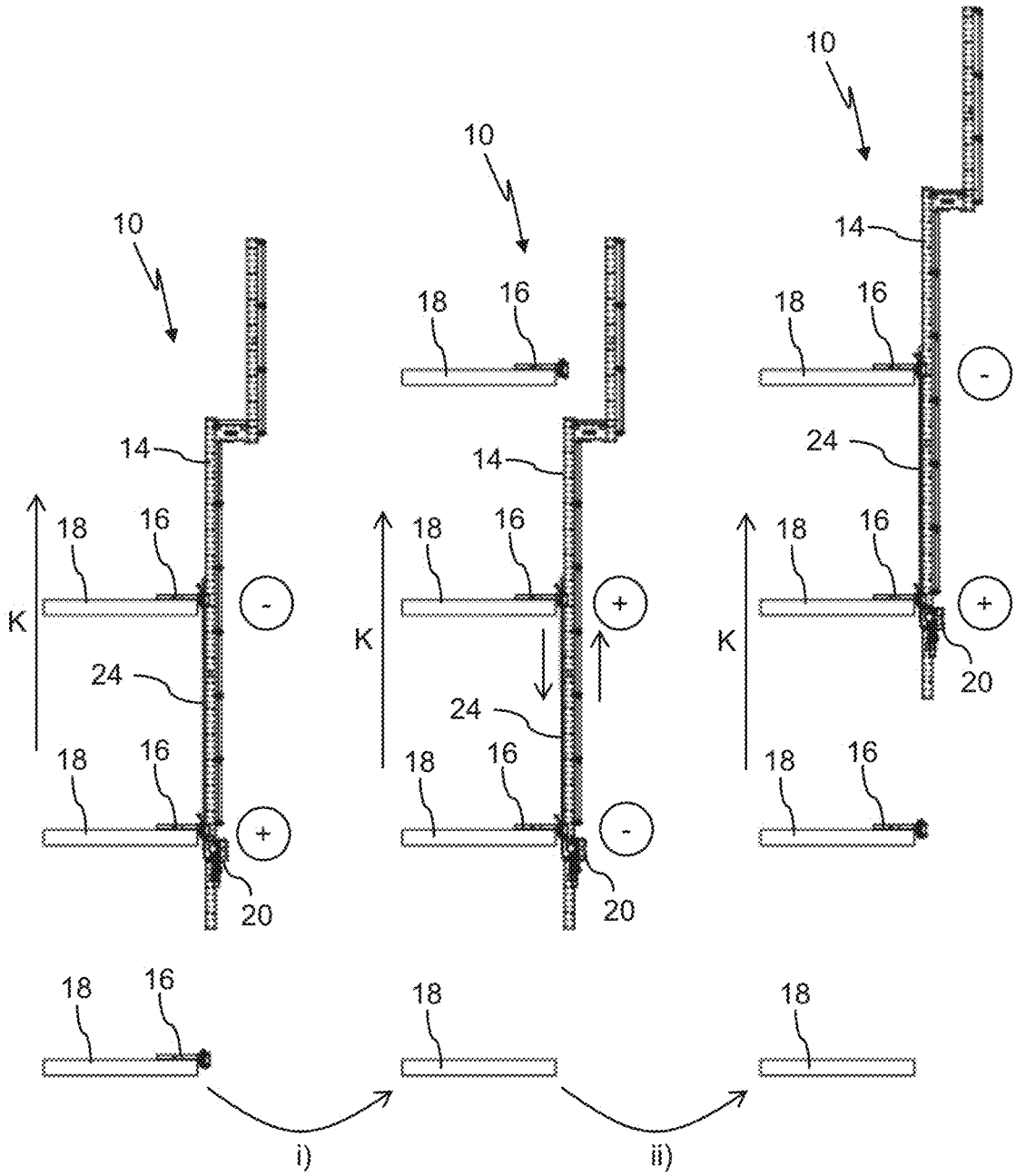
FIG. 6, FIG. 7 and FIG. 8 side views of the self-climbing system of the FIG. 1 at different stages of a climbing process.

FIG. 6, FIG. 7 and FIG. 8 show side views of the self-climbing system 10 at different stages of a climbing process. The method according to the invention for operating a self-climbing system according to the invention is described hereafter in greater detail based on these figures, with reference to the self-climbing system 10.

The self-climbing system 10, by means of which climbing in the vertical direction K is to be accomplished via several concreting sections 18 that are vertically spaced apart is shown again. Topmost new concreting sections 18, i.e. building floors, are produced at the same time with support by the self-climbing system 10.

The climbing rails 12 are concealed in the side views; the climbing rails 14 of the self-climbing system 10 are respectively led past several climbing shoes 16. The climbing shoes 16 are again fastened to the respective concreting sections 18.

Climbing shoes 16 in which or within whose domain the respective chain 24 revolving about the respective chain rail 12, 14 is blocked by means of a fixing pin 34 (FIG. 5), i.e. wherein fixing devices 38 (FIG. 5) are activated, are marked by "+" signs in FIG. 6 to FIG. 8. Climbing shoes 16 in which or within the domain of which the respective chain 24 revolving about the respective chain rails 12, 14 are not blocked by means of a fixing pin 34 (FIG. 5), i.e. wherein the fixing pins 38 (FIG. 5) are deactivated, are marked with a "–" sign in FIG. 6 to FIG. 8. Climbing shoes 16 for which the state of the fixing devices 38 is irrelevant to the climbing process in the respective climbing stage are not marked.

The climbing rails 12, 14 are, in particular, guided into the climbing shoes 16 respectively marked with a "+" or a "–" sign; these climbing shoes 16, in particular, stop them from tilting away, but they can nevertheless be displaced in the climbing direction.

The respective chains 24 in and/or in the domain of the climbing shoes 16 marked with "+" signs are additionally blocked. The climbing rails 12, 14 are indirectly (movably) braced by way of these climbing shoes 16 onto the respective concreting sections 18 over the chains 24. These climbing shoes 16 thus take up the respective loads of the climbing rails 12, 14 via the respective chains 24.

FIG. 6 firstly shows three concreting sections 18. At this stage of the climbing process, another concreting section 18 is constructed above the previously highest concreting section 18, for example using the work platform 21. This new concreting section 18 is thus visible in FIG. 7 and FIG. 8.

As a starting point of the climbing process, FIG. 6 shows a climbing stage wherein the chains 24 are blocked in the lowest climbing shoes 16, into which the climbing rails 12, 14 are led, i.e. those whose fixing devices 38 are activated. Fixing devices 38 along the climbing rails 12, 14, but above these climbing shoes 16, are deactivated. The chains 24 in FIG. 6 are thus blocked in the regions of the second lowest concreting sections 18 and disengaged in the region of the third lowest concreting sections 18.

The actuators 20 are first deactivated, i.e. the respective chains 24 are fixed relative to the respective climbing rail 12, 14.

In a first process step i), the fixing devices 38 of the uppermost climbing shoes 16 along the climbing rails 12, 14, i.e. those of the third-lowest concreting sections 18, are activated. Fixing devices 38 lying along the climbing rails 12, 14 below them are deactivated.

Climbing shoes 16 no longer needed for the further climbing process along the climbing direction K are unassembled from the respective concreting sections 18. These climbing shoes 16 are thereafter again installed at the uppermost-cured-concreting sections 18.

The climbing stage in accordance with FIG. 7 is reached.

The actuators 20 are now activated in a subsequent, second process step ii). Because of this, the chains 24 revolve about their respective climbing rails 12, 14 and/or the respective length sections L (FIG. 2, FIG. 3) at least relative to the respective climbing rail 12, 14. For purposes of going in the desired climbing direction K, i.e. for purposes of climbing upward, the chains 24 are, in the representation in accordance with FIG. 7, moved by the actuators 20 in a counter-clockwise direction relative to the respective climbing rail 12, 14 (marked by directional arrows in FIG. 7). In other words, the chains 24 are moved with respect to the respective climbing rails 24, while the chains 24 are blocked, at least on their left-side sections in accordance with FIG. 7, within the region of the respective climbing shoes 16 and/or in the climbing shoes 16 with activated fixing devices 38 (FIG. 5).

The climbing rails 12, 14 thus pull the left side sections of the chains 24 along the climbing direction K, i.e. upward, as shown in FIG. 7.

As soon as the actuators 20 reach the lower, deactivated fixing devices 38 and/or the lower climbing shoes 16 associated with them, the guidance slots 30 disposed on these climbing shoes 16 open up (FIG. 4, FIG. 5). The respective chains 24 and thereafter the climbing rails 12, 14 can thus leave these lower climbing shoes 16. Guidance of the climbing rails 12, 14 is typically initially maintained after the guidance slots 30 have been opened.

The climbing rails 12, 14 reach the uppermost, last installed climbing shoes 16. They are now taken up in these uppermost climbing shoes 16 for further guidance. As soon as the respective chains 24 also reach these highest climbing shoes 16, they also are taken up via the respective guidance slots 30. These guidance slots 30 are closed. The associated, currently uppermost fixing devices 38 are, if need be, deactivated or remain deactivated until the climbing rails 12, 14 have been climbed sufficiently for the actuators 20 to reach the climbing shoes 16 or at least a pre-defined region in the proximity of these climbing shoes 16, with activated fixing devices 38.

The climbing stage shown in FIG. 8 is thus reached.

It can be seen that, in comparison with the initial stage in accordance with FIG. 6, the climbing rails 12, 14 are altogether climbed in the climbing direction, i.e. upward, past a concreting section 18, by way of the process steps i) and ii).

The climbing process can thereafter be continued, as required and/or as desired, by way of a cyclic repetition of the process steps i) and ii).

The FIGS. 9*a* to 14*b* show a climbing system 10 according to the invention in different stages of the installation, locking and unlocking a climbing rail 12 and a drive means in the form of a chain 24 in and/or at a climbing shoe of the self-climbing system 10. Each of the partial figures shows a perspective view as seen from diagonally above. The partial figures b are respectively views from above with the line of sight parallel to the climbing rail 12.

Figure 9A:
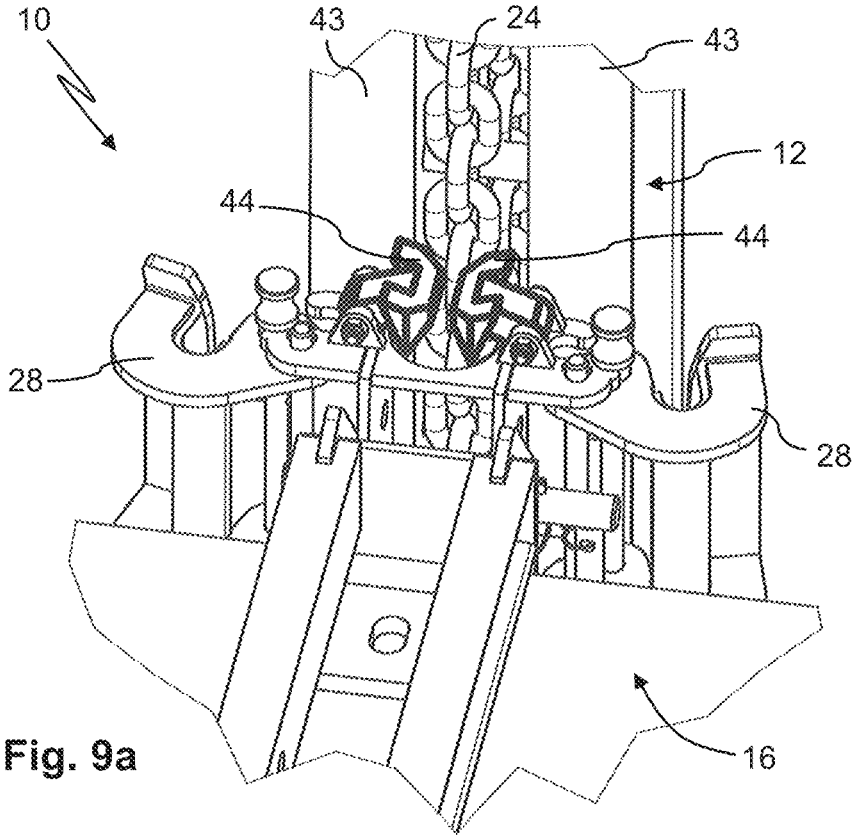
FIGS. 9*a*, 9*b*, 10*a*, 10*b*, 11*a*, 11*b*, 12*a*, 12*b*, 13*a*, 13*b*, 14*a* and 14*b*
Figure 9B:
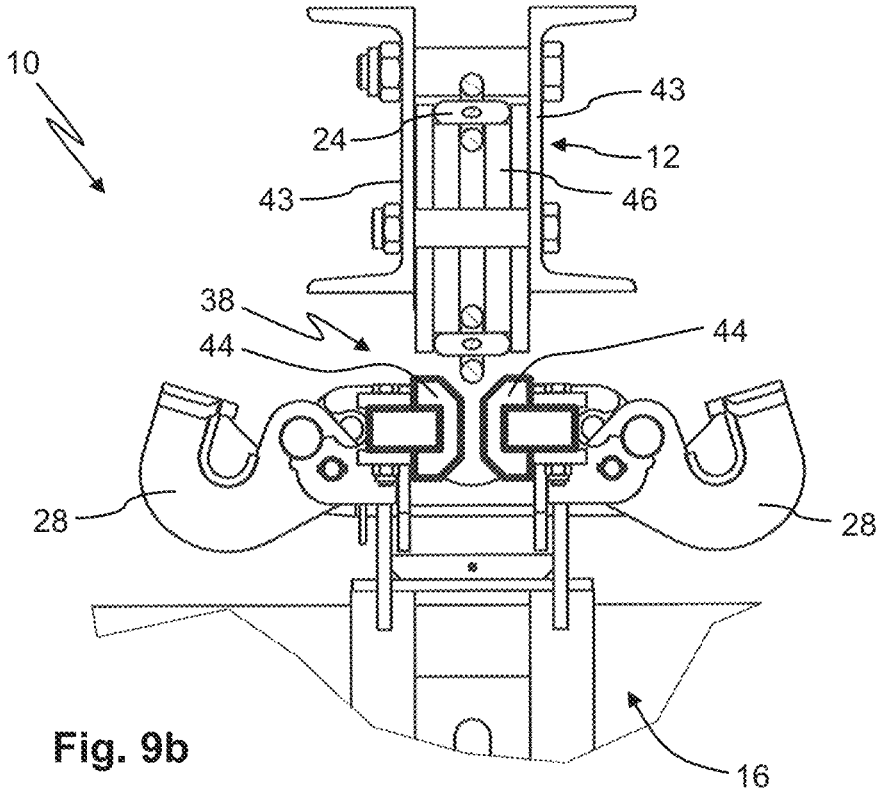

In FIGS. 9*a* and 9*b*, the climbing rail 12 is disposed with the chain 24 spaced from the climbing shoe 16. The climbing rail 12 here comprises two U-channels 43 rigidly tied to each other at a distance.

The climbing shoe 16 comprises a pair of claws 28, which are open in this instance. The claws 28 can be swiveled about an axis of rotation, which, in this case, extends parallel to the climbing rail 12.

The climbing shoe 16 furthermore comprises a fixing device 38 for the drive means. This fixing device 38 has two retaining clamps 44. The retaining clamps 44 are held on the climbing shoe 16 in a movable way, in this case so that the retaining clamps 44 can respectively be pivoted about a pivot axis running along the climbing rail 12. The retaining clamps 44 can, in this case, be moved toward and/or away from each other by rotating about a pivot axis. The retaining clamps 44 can be pretensioned against each other, perhaps spring tensioned, in a way not shown in the drawings.

The drive means of the self-climbing system is here a chain 24 in the form of a link chain (round steel chain). The respective chain 24 is respectively guided through means of redirection at its turning point. The lower means of redirection shown here is a pocket wheel 46. The upper means of redirection, which is not shown, is typically also a pocket wheel.

Figure 10A:
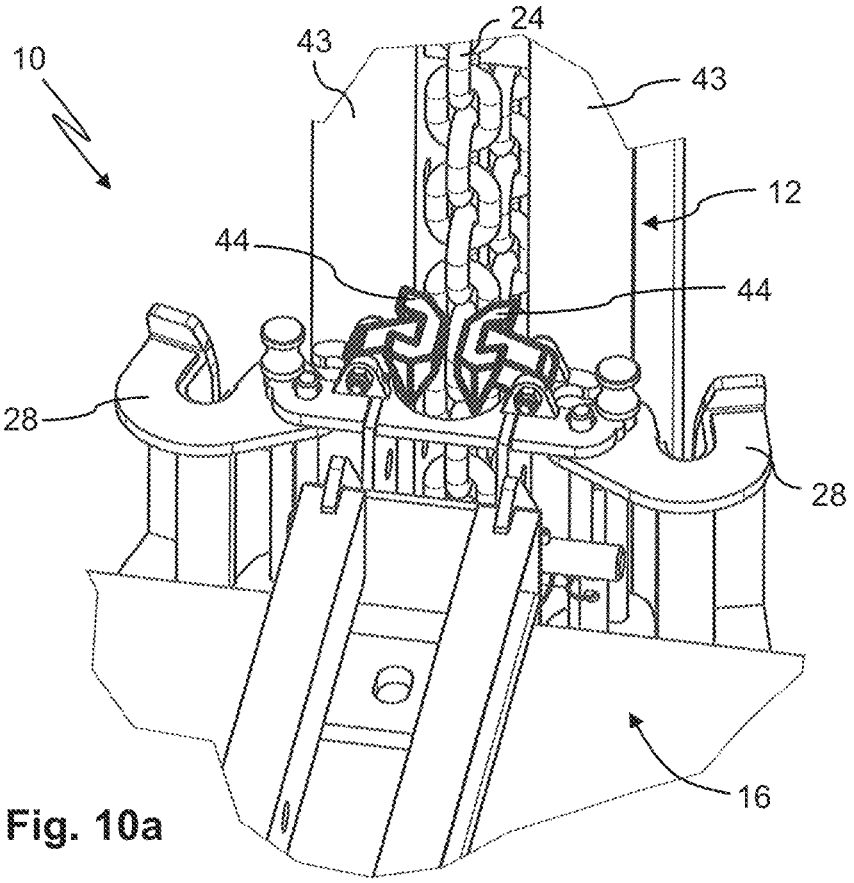
Figure 10B:
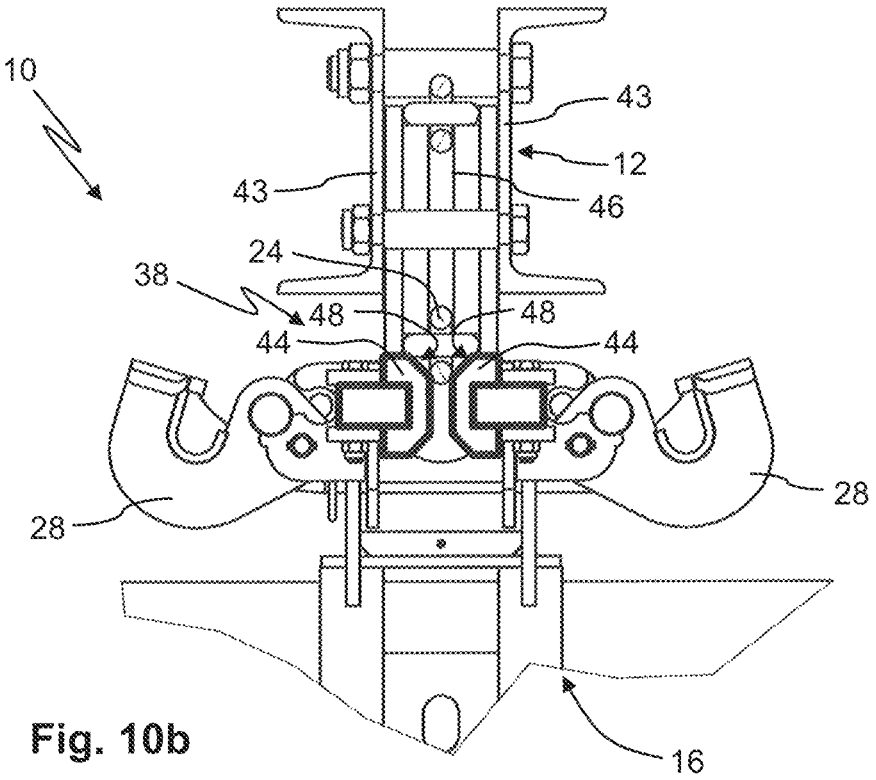

In the state in accordance with FIG. 10*a*, 10*b*, the climbing rail 12 along with the chain 24 is moved forward even more toward the climbing shoe 16. The chain 24 now rests on the sloping surfaces 48 of the retaining clamps 44 of the climbing shoe 16.

Figure 11A:
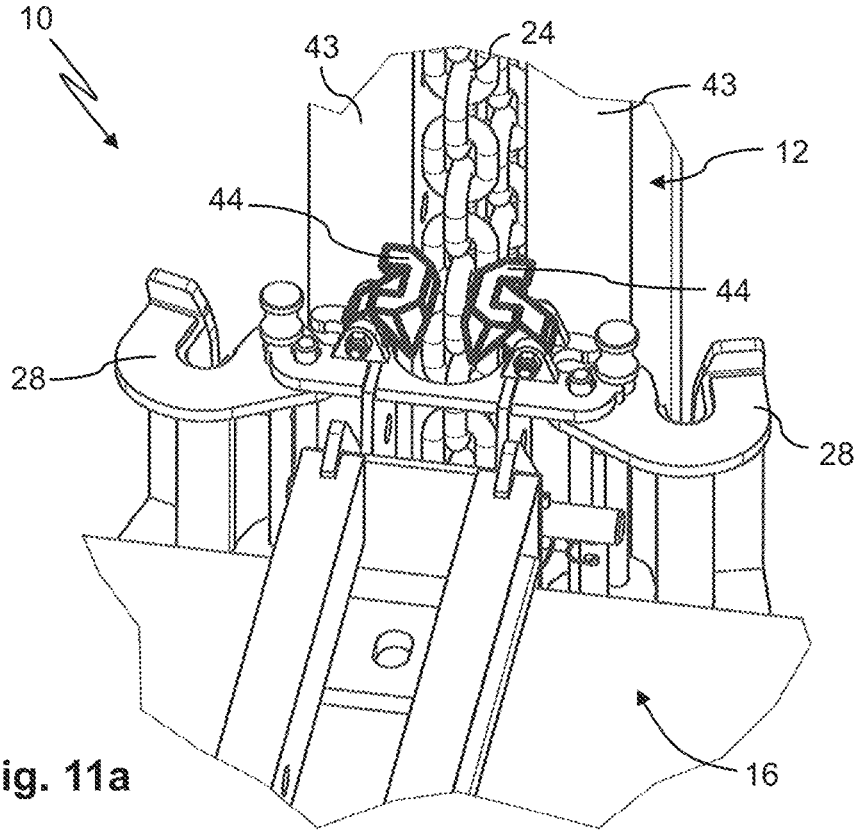
Figure 11B:
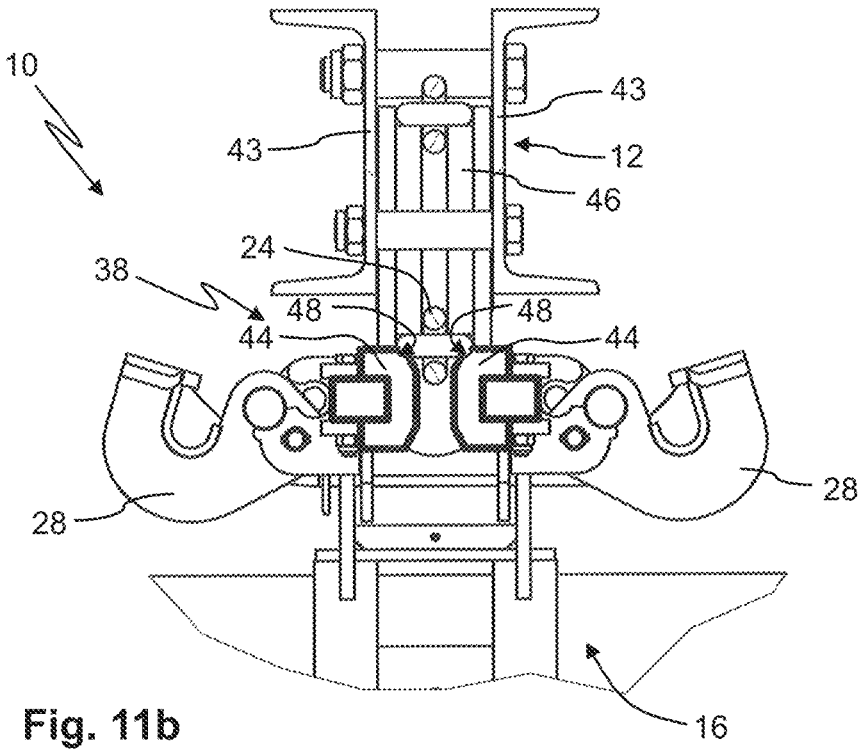

In the configuration of FIG. 11*a*, 11*b* the climbing rail 12 with the chain 24 is advanced even further forward in the direction of the climbing shoe 16. The chain 24 spreads the retaining clamps 44 apart at their first sloping surfaces 48.

Figure 12A:
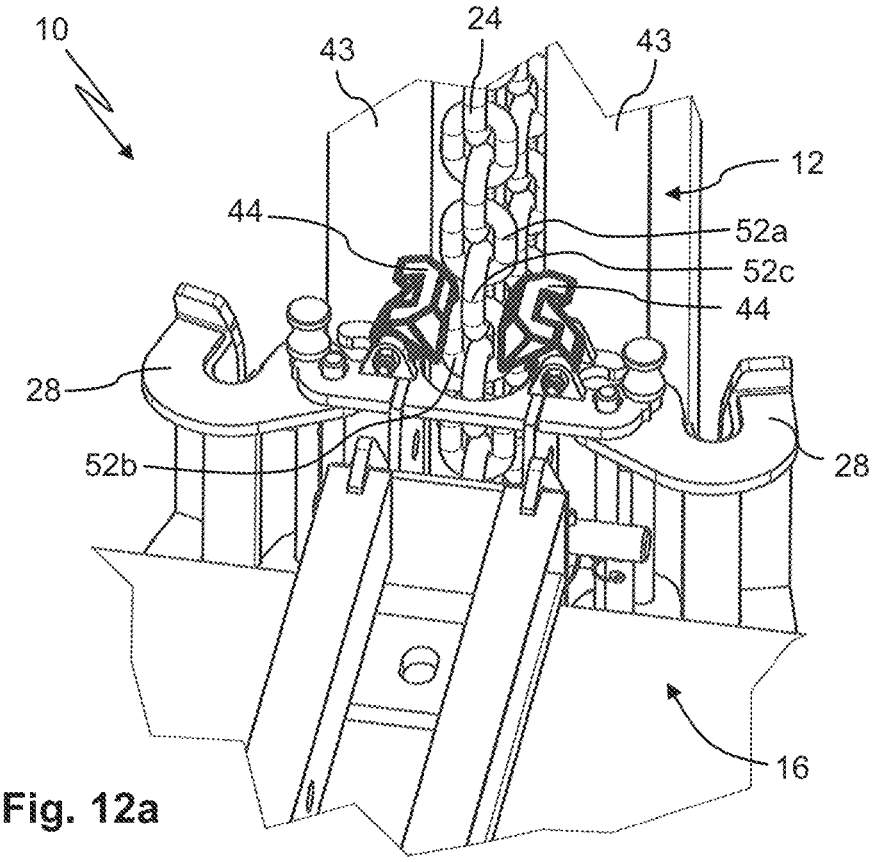
Figure 12B:
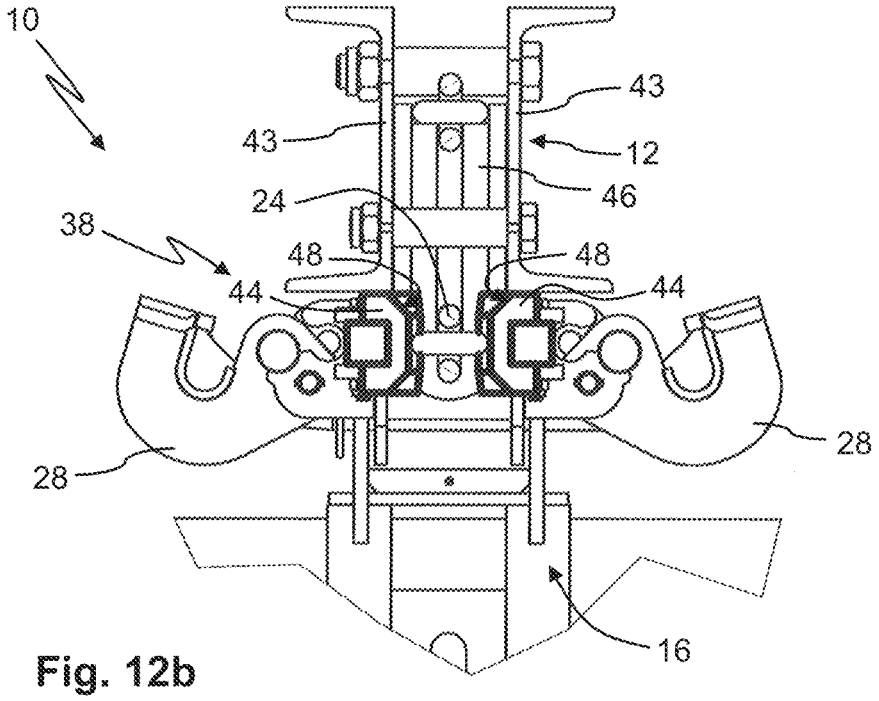

FIG. 12*a*, 12*b* shows the situation after the climbing rail 12 with the chain 24 has been pushed forward far enough to close the claws 28 of the climbing shoe 16, i.e. pushed closer to the climbing shoe 16. A section of the chain 24 on the climbing shoe side is now centered between the retaining clamps 44. The retaining clamps 44 are still open in the situation being depicted and do not engage the chain 24. In this configuration the chain 24 is not blocked at the climbing shoe 16.

Figure 13A:
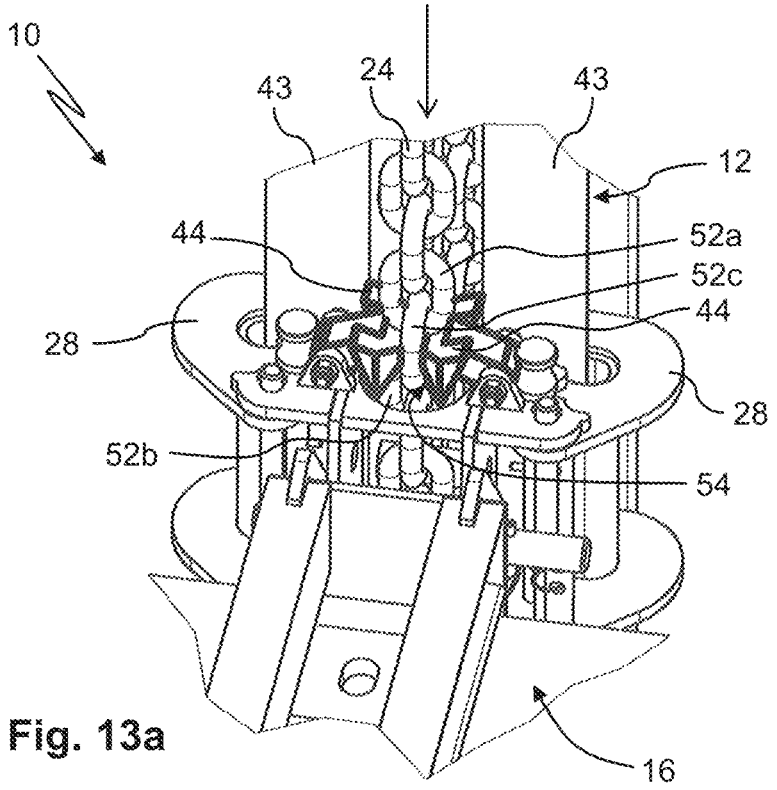
Figure 13B:
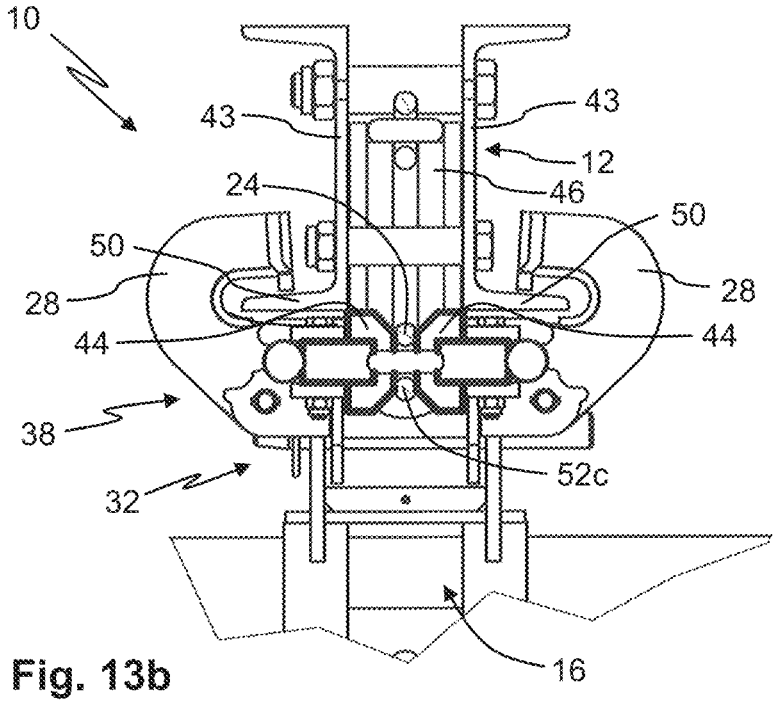

FIG. 13*a*, 13*b* shows the self-climbing system 10 after the claws 28 are closed and the chain 24 has been blocked at the climbing shoe 16. The claws 28 were pivoted about their respective axes of rotation as compared to their status in accordance with FIG. 12*a*, 12*b*. Each of the claws 28 now clasp a flange 50 of a U-channel 43 of the climbing rail 12. The climbing rail 12 thus cannot be removed from the climbing shoe 16; it is, in other words, fixed at the climbing shoe 16. A slot barrier 32 not represented in detail prevents any opening of the claws 28.

The retaining clamps 44 engage between two chain links 52*a*, 52*b* of the chain 24 extending approximately parallel to the flanges 50 of the U-channels 43 of the climbing rail 12. The retaining clamps 44 then lie against a chain link 52*c* oriented crosswise with respect to the flanges, between the two chain links 52*a*, 52*b*. To make it possible for the retaining clamps 44 to engage the chain 24, the chain 24 was moved downward with respect to the configuration in accordance with FIG. 12*a*, 12*b*, in the direction of the arrow shown in FIG. 13*a*. This way, the retaining clamps 44, assisted by the preload between them, are taken up between the chain links 52*a*, 52*c*. Any further movement of the chain 24 relative to the climbing shoe 16, in the direction of the arrow, is prevented by the fact that the chain link 52*a* rests on top of the retaining clamps 44. Because of the location of the swivel axis of the retaining clamps 44, the application of force from above to the retaining clamps 44 by the chain 24 causes the retaining clamps 44 to be pressed even closer to each other. This is prevented by the chain link 52*c* clamped between the retaining clamps 44. The blocking effect of the fixing device relies on the form fit between the retaining clamps 44 and the chain link 52*a* lying on top of it. The fixing device 38 is self-locking regarding a movement of the chain 24 with respect to the climbing shoe 16, in the direction of the arrow.

Figure 14A:
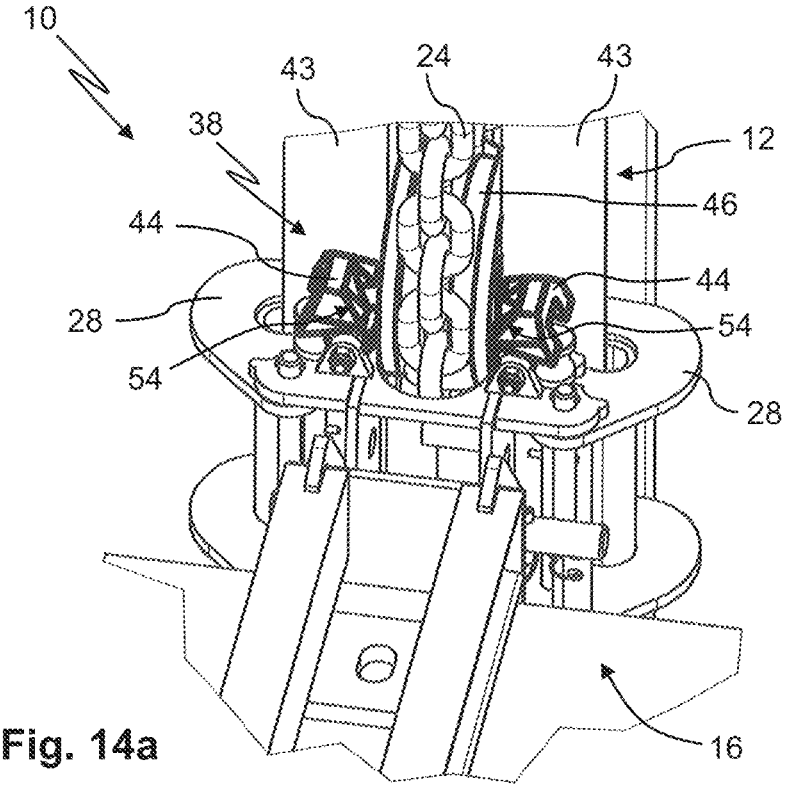
Figure 14B:
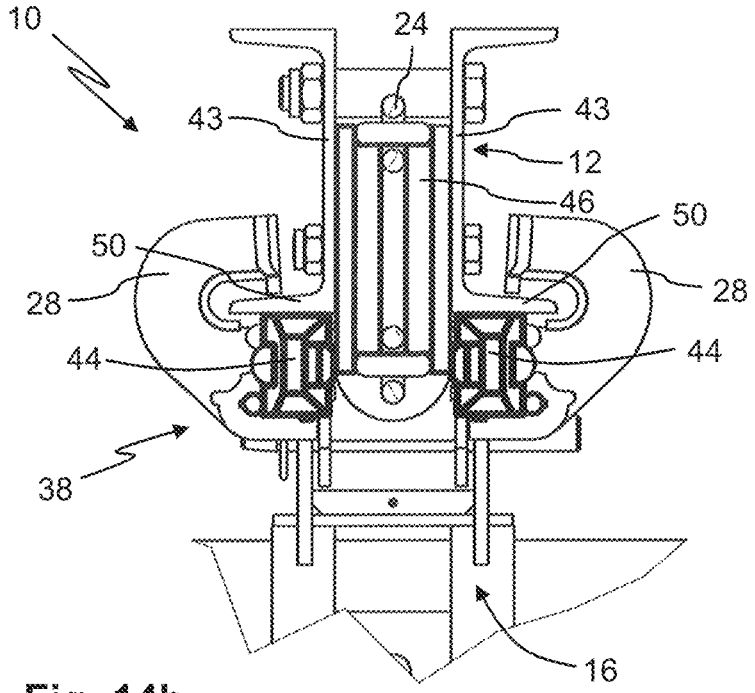

In the configuration of the self-climbing system 10 shown in FIG. 14*a*, 14*b*, the load rail 12 has been climbed further as compared to the configuration of FIG. 13*a*, 13*b*, i.e. with respect to the climbing shoe 16, i.e. out of the plane of the drawing of FIG. 13*b*, 14*b* and toward the viewer. The claws 28 of the climbing shoe 16 also encompass the climbing rail 12 in the configuration of FIG. 14*a*, 14*b*.

The fixing device 38 is now unlocked. The retaining clamps 44 no longer engage the chain 24. The retaining clamps 44 are pressed outward from the pocket wheel 46 to unlock the fixing device 38. In climbing the climbing rail 12 between the configurations of FIG. 13*a*, 13*b* and FIG. 14*a*, 14*b*, the pocket wheel 46 is unreeled on the chain strand underneath the climbing shoe 16 of the fixed chain 24, until the pocket wheel 46 has reached the climbing shoe 16. In continuing to climb, the pocket wheel 46 has pressed the retaining clamps 44 outward over second sloping surfaces 54 formed underneath, at the retaining clamps 44. The retaining clamps 44 thus reach the position where they can no longer engage the chain 24. One should note that the retaining clamps are swiveled outward by about 90° in FIG. 14*a*, 14*b* as compared with FIG. 13*a*, 13*b*. The pocket wheel 46 is now located between the retaining clamps 44 of the fixing device 38. In continuing to climb, the load rail is, for the moment, guided to the climbing shoe 16 by the claws 28. The chain 24 is blocked from climbing to a further climbing shoe (not shown) lying further in front in the climbing direction by means of its fixing device.

The invention claimed is:

1. A self-climbing system comprising at least one climbing rail attached to at least two climbing shoes, with the at least two climbing shoes being attachable to and/or on a hardened concreting section, and an actuator arranged along the at least one climbing rail, wherein, a circumferential drive means is disposed along the climbing rail, at least over a length section of the climbing rail, which drive means is movable with respect to the climbing rail by means of the actuator and can be blocked or unblocked with respect to the climbing rail in the domain of one or more of the two climbing shoes and/or in one or more of the climbing shoes by means of at least one fixing device for the drive means, wherein, when the drive means is fixed relative to one of the two climbing shoes of the self-climbing system, a movement of the drive means in its longitudinal direction relative to the one climbing shoe is prevented and the drive means remains movable with respect to the climbing rail while it is in its fixed condition relative to the one climbing shoe, wherein the self-climbing system climbs continuously and without interruption.

2. The self-climbing system according to claim 1, wherein the circumferential drive means is a chain, comprising one of a continuous chain, belt, or ribbon.

3. The self-climbing system according to claim 2, wherein the at least one climbing rail has at least two means of redirection for redirecting the drive means, wherein the means of redirection comprises one of: gear wheels, chain wheels, pocket wheels, or deflection rollers.

4. The self-climbing system according to claim 2, wherein the chain is a link chain or a roller chain or that the belt is a toothed belt.

5. The self-climbing system according to claim 1, wherein the actuator is an electric, hydraulic and/or pneumatic and/or self-locking drive or features such a drive.

6. The self-climbing system according to claim 1, wherein a guide for the drive means is disposed at the climbing shoes.

7. The self-climbing system according to claim 6, wherein the guide is configured as a guide slot for carrying the drive means through the slot and that the guide slot and/or the climbing shoe can be opened for purposes of withdrawing the drive means.

8. The self-climbing system according to claim 7, wherein opening of the guide slot by means of a slot barrier is blocked and/or at least can be blocked if the climbing shoe associated with the guide slot is located in a pre-defined climbing range with respect to the drive means and/or the climbing rail.

9. The self-climbing system according to claim 7, wherein the guide slot is located between at least two claws that can be strutted apart.

10. The self-climbing system according to claim 1, wherein at least one climbing shoe is a floor and/or a wall climbing shoe.

11. The self-climbing system according to claim 1, wherein the fixing device is at least one fixing pin, a claw or a latch and/or that the fixing device comprises at least one fixing pin, a claw or a latch, with the fixing device being configured to stationarily block or release the drive means in the region of a climbing shoe.

12. The self-climbing system according to claim 11, wherein the fixing device can be operated manually, automatically, by remote control, or independently and/or in a controlled manner at the climbing shoe respectively associated therewith.

13. The self-climbing system according to claim 1, wherein the fixing device has a snap-in locking device by means of which the drive means can be locked at least along the climbing direction so as to stationarily fix the drive means to the snap-in locking device.

14. The self-climbing system according to claim 1, wherein the self-climbing system has at least one status sensor for recording and/or monitoring the lifting power of the drive means, the tension of the drive means, the position and/or the circumferential speed of the drive means, the position of the climbing rail, the torque and/or the rotation speed of a drive wheel of the actuator in running the drive means.

15. The self-climbing system according to claim 14, wherein the position of the climbing rail comprises the position with respect to at least one of the climbing shoes and/or with respect to the drive means.

16. The self-climbing system according to claim 1, wherein the self-climbing system comprises an additional climbing rail with a drive means moving around the additional climbing rail, where the self-climbing system is designed to move the drive means and the additional drive means in a coordinated manner.

17. The self-climbing system according to claim 1, wherein the self-climbing system has a work platform, a finishing platform, a protective housing, a formwork system and/or a protective grille.

18. A method for operating a self-climbing system according to claim 1, wherein, the drive means is moved with respect to the climbing rail in a climbing process, while the drive means is, at least in sections, blocked in the region of a climbing shoe and/or is blocked in the climbing shoe.

19. The self-climbing system according to claim 1, wherein a lengthwise section (L) of the climbing rail with the drive means can be clasped by the at least two climbing shoes or taken up in the at least two climbing shoes.

20. A self-climbing system, comprising:

at least two climbing shoes configured to attach to and/or on a hardened concreting section;

at least one climbing rail attached to the at least two climbing shoes;

an actuator arranged along the at least one climbing rail; and a circumferential drive mechanism disposed along the at least one climbing rail, at least over a length section of the at least one climbing rail, the drive mechanism being movable with respect to the at least one climbing rail by means of the actuator and configured to be blocked or unblocked with respect to the at least one climbing rail in the domain of one or more of the two climbing shoes and/or in one or more of the climbing shoes by means of at least one fixing device for the drive mechanism, wherein, when the drive mechanism is fixed relative to one of the two climbing shoes of the self-climbing system, a movement of the drive mechanism in a longitudinal direction relative to the one climbing shoe is prevented and the drive mechanism remains movable with respect to the at least one climbing rail while it is in its fixed condition relative to the one climbing shoe, wherein the self-climbing system climbs continuously and without interruption.

* * * * *